US007461468B2

(12) United States Patent
Grilliot et al.

(10) Patent No.: US 7,461,468 B2
(45) Date of Patent: Dec. 9, 2008

(54) BOOT AND LINER COMBINATION

(75) Inventors: William L. Grilliot, Dayton, OH (US); Mary I. Grilliot, Dayton, OH (US)

(73) Assignee: Morning Pride Manufacturing, L.L.C., Dayton, OH (US)

( * ) Notice: Subject to any disclaimer, the term of this patent is extended or adjusted under 35 U.S.C. 154(b) by 602 days.

(21) Appl. No.: 10/985,764

(22) Filed: Nov. 10, 2004

(65) Prior Publication Data

US 2006/0096122 A1 May 11, 2006

(51) Int. Cl.
*A43B 17/00* (2006.01)

(52) U.S. Cl. ..... 36/10; 36/43; 36/80; 36/58.6; 36/88

(58) Field of Classification Search ..... 36/10, 36/55, 113, 71, 117.6, 69, 88, 2 R, 43–44, 36/80, 58.6, 138, 7.3; 2/227
See application file for complete search history.

(56) References Cited

U.S. PATENT DOCUMENTS 3,618,232 A * 11/1971 Shnuriwsky ..... 36/1.5
4,575,954 A 3/1986 Bye
4,708,272 A * 11/1987 Guerra ..... 223/113
4,748,749 A * 6/1988 Colvard ..... 36/2 R
4,771,553 A 9/1988 Smithdeal
4,864,742 A 9/1989 Grilliot et al.
5,131,098 A 7/1992 Grilliot et al.
5,593,453 A * 1/1997 Ahlert ..... 623/27
5,884,332 A 3/1999 Snedeker
5,974,591 A 11/1999 Leslie
6,134,717 A 10/2000 Grilliot et al.
6,311,412 B1 11/2001 Grilliot et al.

OTHER PUBLICATIONS

International Search Report and Written Opinion in PCT/US05/01049, which corresponds to this application.

* cited by examiner

*Primary Examiner*—Jila M Mohandesi
(74) *Attorney, Agent, or Firm*—Wood, Phillips, Katz, Clark & Mortimer

(57) ABSTRACT

As worn with a pull-on boot, a pair of pants has an outer shell and a liner, which has a leg-covering portion and a foot-covering portion. In a ready-to-don condition, the pull-on boot is placed onto a horizontal surface so as to open upwardly, the foot-covering portion is fitted into the pull-on boot. and the outer shell is fitted over the pull-on boot, whereupon the pair of pants is pulled downwardly, over the pull-on boot, toward the horizontal surface. The foot-covering portion of the liner may be detachably attached to and within the boot, as by hook-and-loop attaching means, when the combination has been manipulated to the ready-to-don position. The liner has a pair of pull-on loops, each of which is attached to and within the liner so as to be manually graspable when the combination has been manipulated into the ready-to-don condition.

12 Claims, 1 Drawing Sheet

BOOT AND LINER COMBINATION

TECHNICAL FIELD OF THE INVENTION

This invention pertains to a combination comprising a boot and a liner, which has a leg-covering portion and a foot-covering portion, wherein the combination can be advantageously worn by a wearer, such as a firefighter, who needs quickly to don the combination and to doff the combination.

BACKGROUND OF THE INVENTION

A protective garment for a firefighter is known, in which a boot liner is attached permanently to each leg of a pair of pants. Such a garment is disclosed in U.S. Pat. No. 6,134,717, the disclosure of which is incorporated herein by reference. A boot, liner, and insole combination of related interest is disclosed in U.S. Pat. No. 6,311,412 B1, the disclosure of which is incorporated herein by reference.

As explained in U.S. Pat. No. 6,311,412 B1, supra, a practice is known wherein the boot liners are fitted into the boots before the firefighter dons the protective garment and the boots, so that the firefighter can don the pants, boot liners, and boots together, as a combination, whereby potentially valuable time can be saved.

In the combination disclosed in U.S. Pat. No. 6,311,412 B1, supra, the insole is attached permanently, as by stitches, or detachably, as by hook-and-loop fastening means, to a sole portion of the liner. The insole and the liner are fittable into the boot, which has a recess adapted to receive a tongue provided by the insole, so as to hold the insole and the liner when both are fitted into the boot.

SUMMARY OF THE INVENTION

This invention provides improvements in a combination comprising a pull-on boot and a liner, which has a leg-covering portion and a foot-covering portion, wherein the combination is manipulatable into a ready-to-don condition, in which the pull-on boot is placed onto a horizontal surface so as to open upwardly and the foot-covering portion is fitted into the pull-on boot, whereupon the liner is pulled downwardly, over the pull-on boot, toward the horizontal surface. The foot-covering portion of the liner is affixed to or is unitary with the leg-covering portion of the liner.

In the ready-to-don condition, if the liner is a liner of a pair of pants having an outer shell, the pull-on boot is placed onto a horizontal surface so as to open upwardly, the foot-covering portion is fitted into the pull-on boot, and the outer shell is fitted over the pull-on boot, whereupon the pair of pants is pulled downwardly, over the pull-on boot, toward the horizontal surface As contemplated by this invention, the liner has a pull-on loop, which is attached to and within the liner so as to be manually graspable when the combination has been manipulated into the ready-to-don condition. Preferably, the pull-on loop is one of a pair of pull-on loops, each of which is attached to and within the liner so as to be manually graspable when the combination has been manipulated into the ready-to-don condition.

Preferably, the foot-covering portion of the liner, as fitted into the pull-on boot, is attached detachably to and within the pull-on boot. Hook-and-loop fastening means are useful for attaching the foot-covering portion of the liner, as fitted into the pull-on boot, detachably to and within the pull-on boot.

DETAILED DESCRIPTION OF THE ILLUSTRATED EMBODIMENTS

Figure 1:
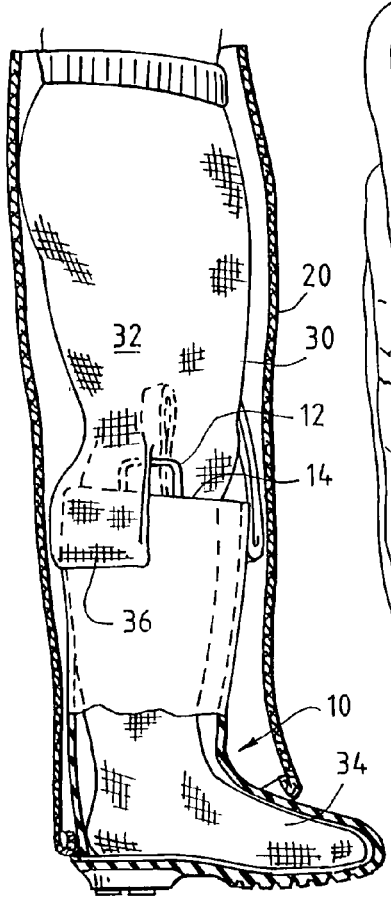
FIG. 1 is a fragmentary, cross-sectional view illustrating one leg of a wearer wearing a pull-on boot and wearing a pair of pants including a liner, where the boot and the liner provide a combination embodying this invention.
Figure 2:
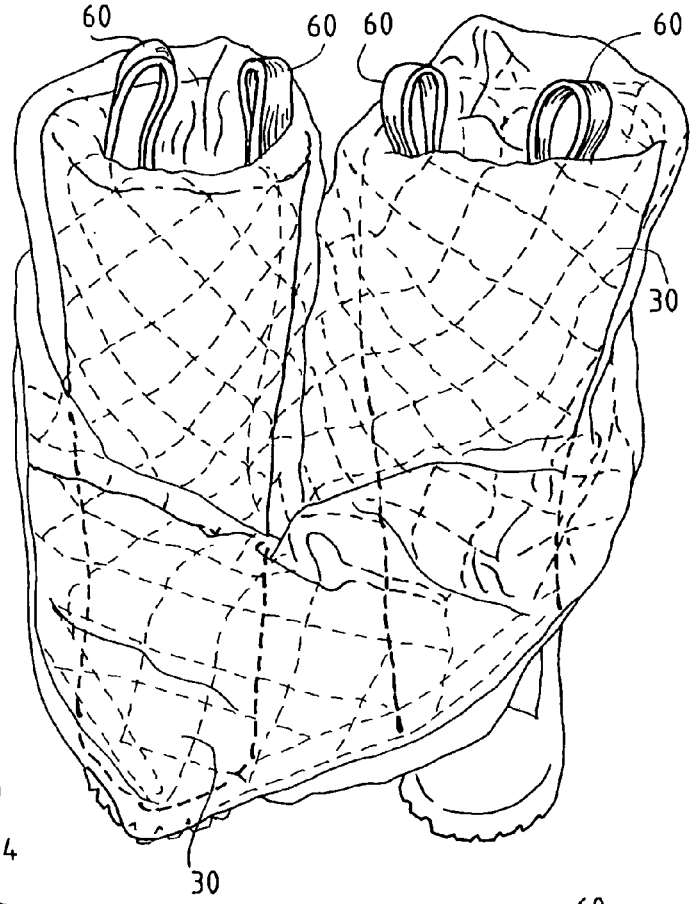
FIG. 2 is a perspective view illustrating both legs of the pair of pants and illustrating the liner, in a ready-to-don condition, in which two pull-on loops attached to and within the liner can be manually grasped.

As illustrated, this invention is embodied in a combination comprising, on each of two legs of a wearer, a pull-on boot 10 having pull-on loops 12 projecting upwardly beyond an upper edge 14 of the pull-on boot 10, one of which loops 12 appears in FIG. 1, an outer shell 20 of a pair of pants, and an inner liner 30 for the pair of pants. The outer shell 20 is worn outside the pull-on boot 10. The inner liner 30 may be a quilted thermal liner, as illustrated in FIG. 2, and has a leg-covering portion 32, when worn extends downwardly into the pull-on boot 10, and a foot-covering portion 34, which is unitary with the leg-covering portion 32 and which is worn inside the pull-on boot 10. The inner liner 30 has a cuff 36, which is similar structurally and functionally to the cuff disclosed in U.S. Pat. No. 6,134,717, supra.

Figure 1A:
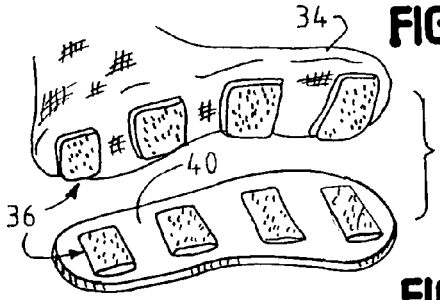
FIG. 1A and FIG. 1B, respectively, are fragmentary, exploded details illustrating how the liner can be detachably attached to and within the boot, in two alternative ways.
Figure 1B:
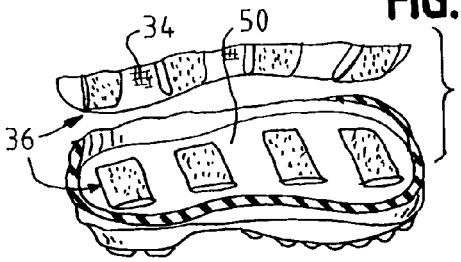

The foot-covering portion 34 is attached detachably, via hook-and-loop fastening means 36, either to a removable insole 40 of the pull-on boot 10, as illustrated in FIG. 1A, or to a permanent insole 50 of the pull-on boot 10, as illustrated in FIG. 1B. Alternatively, the foot-covering portion 34 is sewn or is affixed adhesively to the removable insole 40. If the removable insole 40 is used, the removable insole 40 is fittable into and coacts with the pull-on boot 10 in a manner disclosed in U.S. Pat. No. 6,311,412 B1, supra. Presently, rather than the removable insole 40, the permanent insole 50 is preferred.

Figure 3:
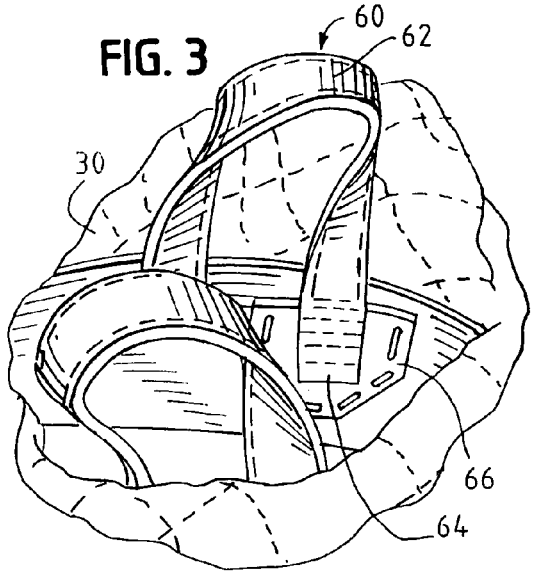
FIG. 3 is an enlarged, fragmentary, perspective detail illustrating the pull-on loops from a different vantage.

As contemplated by this invention, each leg-covering portion 32 of the inner liner 30 has a pair of pull-on loops 60, which are sewn to and within said leg-covering portion 32, so as to project upwardly beyond the upper edge 14 of the pull-on boot 10. As illustrated in FIG. 3, each loop 60 comprises a leather strap 62, which is sewn at each end 64 to a leather patch 66, and the leather patch 66 is sewn to and within the inner liner 30.

In the ready-to-don condition illustrated in FIG. 2, the pull-on boots 10 are placed onto a horizontal surface, such as a floor, so as to open upwardly, the foot-covering portion 34 of the inner liner 30 is fitted into a respective one of the pull-on boots 10, and the outer shell 20 are fitted over the same one of the pull-on boots 10, whereupon the pair of pants comprising, on each leg, the outer shell 20 and the inner liner 30 is pulled downwardly, over the pull-on boots 10, toward the horizontal surface. Thus, the pull-on loops 60 can be manually grasped, whereby to facilitate donning of the combination.

The invention claimed is:

1. A combination comprising a pull-on boot and a liner, which has a leg-covering portion and a foot-covering portion, wherein the combination is manipulatable into a ready-to-don condition, in which the pull-on boot is placed onto a horizontal surface so as to open upwardly and the foot-covering portion is fitted into the pull-on boot, whereupon the liner is pulled downwardly, over the pull-on boot, toward the horizontal surface and exposes an inside surface of the liner that faces a wearer when donned, and wherein the liner has a pull-on loop, which is attached to the inside surface of the liner and is exposed in the ready-to-don condition so as to be manually graspable when the combination has been manipulated into the ready-to-don condition.

2. The combination of claim 1, wherein the pull-on loop is one of a pair of pull-on loops, each of which is attached to the inside surface of the liner to be completely overlaid by the liner when donned and is exposed in the ready-to-don condition so as to be manually graspable when the combination has been manipulated into the ready-to-don condition.

3. The combination of claim 2, wherein the foot-covering portion of the liner, as fitted into the pull-on boot, is attached detachably to and within the pull-on boot.

4. The combination of claim 1, wherein the foot-covering portion of the liner, as fitted into the pull-on boot, is attached detachably to and within the pull-on boot.

5. The combination of claim 1, wherein the foot-covering portion of the liner is attached detachably to and within the boot, by hook-and-loop fastening means, when the combination has been manipulated to the ready-to-don position.

6. A combination comprising a boot and a pair of pants, wherein the pair of pants has an outer shell and a liner, wherein the liner has a leg-covering portion and a foot-covering portion, wherein the combination is manipulatable into a ready-to-don condition, in which the pull-on boot is placed onto a horizontal surface so as to open upwardly, the foot-covering portion is fitted into the pull-on boot, and the outer shell is fitted over the pull-on boot, whereupon the pair of pants is pulled downwardly, over the pull-on boot, toward the horizontal surface and exposes an inside surface of the liner that faces a wearer when donned, and wherein the liner has a pull-on loop, which is attached to the inside surface of the liner to be completely overlaid by the liner when donned and is exposed in the ready-to-don condition so as to be manually graspable when the combination has been manipulated into the ready-to-don condition.

7. The combination of claim 6, wherein the pull-on loop is one of a pair of pull-on loops, each of which is attached to the inside surface of the liner to be completely overlaid by the liner when donned and is exposed in the ready-to-don condition so as to be manually graspable when the combination has been manipulated into the ready-to-don condition.

8. The combination of claim 7, wherein the foot-covering portion of the liner, as fitted into the pull-on boot, is attached detachably to and within the pull-on boot.

9. The combination of claim 6, wherein the foot-covering portion of the liner, as fitted into the pull-on boot, is attached detachably to and within the pull-on boot.

10. The combination of any one of claims 1 through 8, wherein the foot-covering portion of the liner is affixed to the leg-covering portion of the liner.

11. The combination of any one of claims 1 through 8, wherein the foot-covering portion of the liner is unitary with the leg-covering portion of the liner.

12. The combination of any one of claims 1 through 8, wherein the foot-covering portion of the liner is attached detachably to and within the boot when the combination has been manipulated to the ready-to-don position.

* * * * *